US007404731B2

(12) United States Patent
Lim

(10) Patent No.: US 7,404,731 B2
(45) Date of Patent: Jul. 29, 2008

(54) ELECTRICAL CONNECTOR

(75) Inventor: Chee Boon Vincent Lim, Singapore (SG)

(73) Assignee: MEA Technologies, Pte. Ltd., Singapore (SG)

( * ) Notice: Subject to any disclaimer, the term of this patent is extended or adjusted under 35 U.S.C. 154(b) by 0 days.

(21) Appl. No.: 11/944,261

(22) Filed: Nov. 21, 2007

(65) Prior Publication Data

US 2008/0124966 A1 May 29, 2008

(30) Foreign Application Priority Data

Nov. 22, 2006 (SG) ..... 200608113-7

(51) Int. Cl.
*H01R 3/00* (2006.01)

(52) U.S. Cl. ..... 439/489; 439/358

(58) Field of Classification Search ..... 439/489, 439/357, 358, 352, 353
See application file for complete search history.

(56) References Cited

U.S. PATENT DOCUMENTS 6,186,819 B1 2/2001 Holub
6,406,319 B2 * 6/2002 Pederson et al. ..... 439/352
6,824,421 B2 * 11/2004 Oka ..... 439/489
6,942,510 B2 * 9/2005 Nakamura ..... 439/188

FOREIGN PATENT DOCUMENTS

WO 2004/095642 11/2004
WO 2004/109866 12/2004

* cited by examiner

*Primary Examiner*—Tho D Ta
(74) *Attorney, Agent, or Firm*—Osha Liang LLP

(57) ABSTRACT

The electrical connector 1 according to one embodiment of the present invention includes a male connector 13 having a male housing 14 with a first latch part 1, a female connector 2 having a female housing with an inserting hole, and a connector position assurance (CPA) 9. The first latch part 1 has first and second latch protrusions $P_1$, $P_2$, and the female connector 2 has an elastic latch arm 8 with a latch pawl at a leading edge part of the female connector. The CPA 9 includes a first finger piece $\mathbf{9}_2$ having a first bent protrusion $D_1$, second finger pieces $\mathbf{9}_1$, $\mathbf{9}_3$ each having a second bent protrusion $D_2$, and a spring-force-accumulated part. The first and second finger pieces of the CPA 9 are attached between the elastic latch arm and one inner wall surface. While the two connectors 2, 13 are fitted, the male connector slides the CPA backward. When the two connectors have entered into a regular fitted state, the spring-force-accumulated part makes the second latch protrusion $P_2$ latch onto the latch pawl to connect the two connectors. Accordingly, an electrical connector including a fitted state detecting member to lock a pair of its connectors automatically during the fitting process of the connectors and ensure the fitting of the connectors can be provided.

8 Claims, 13 Drawing Sheets

FIG.1
FIG. 1A
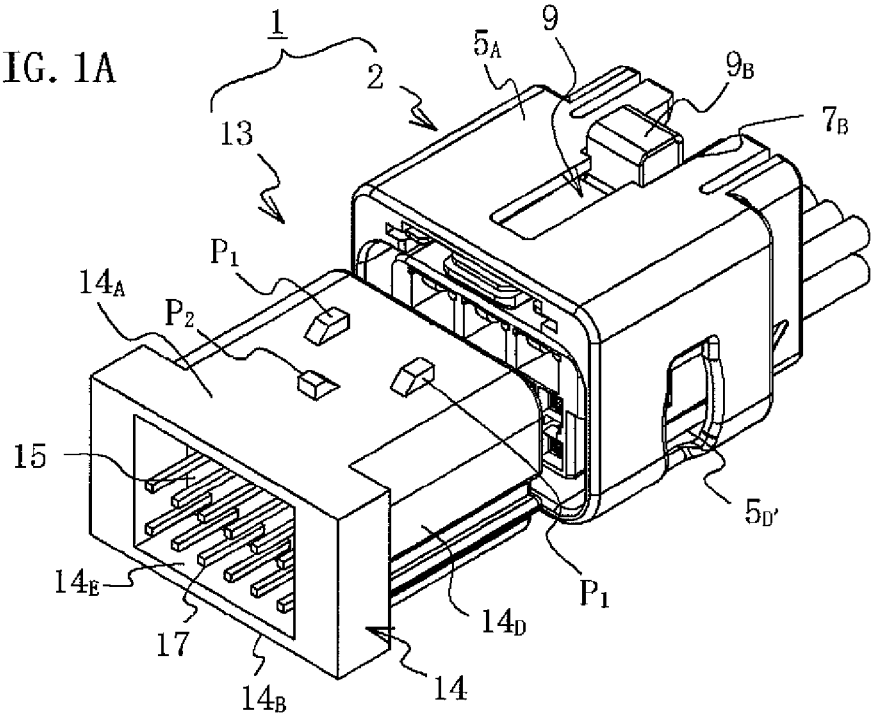
FIG. 1B
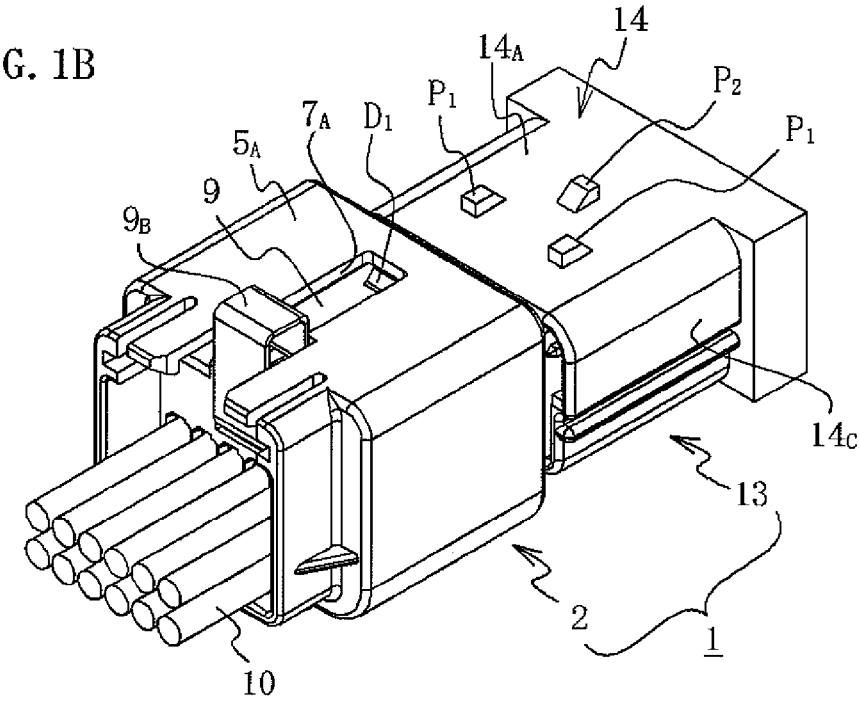

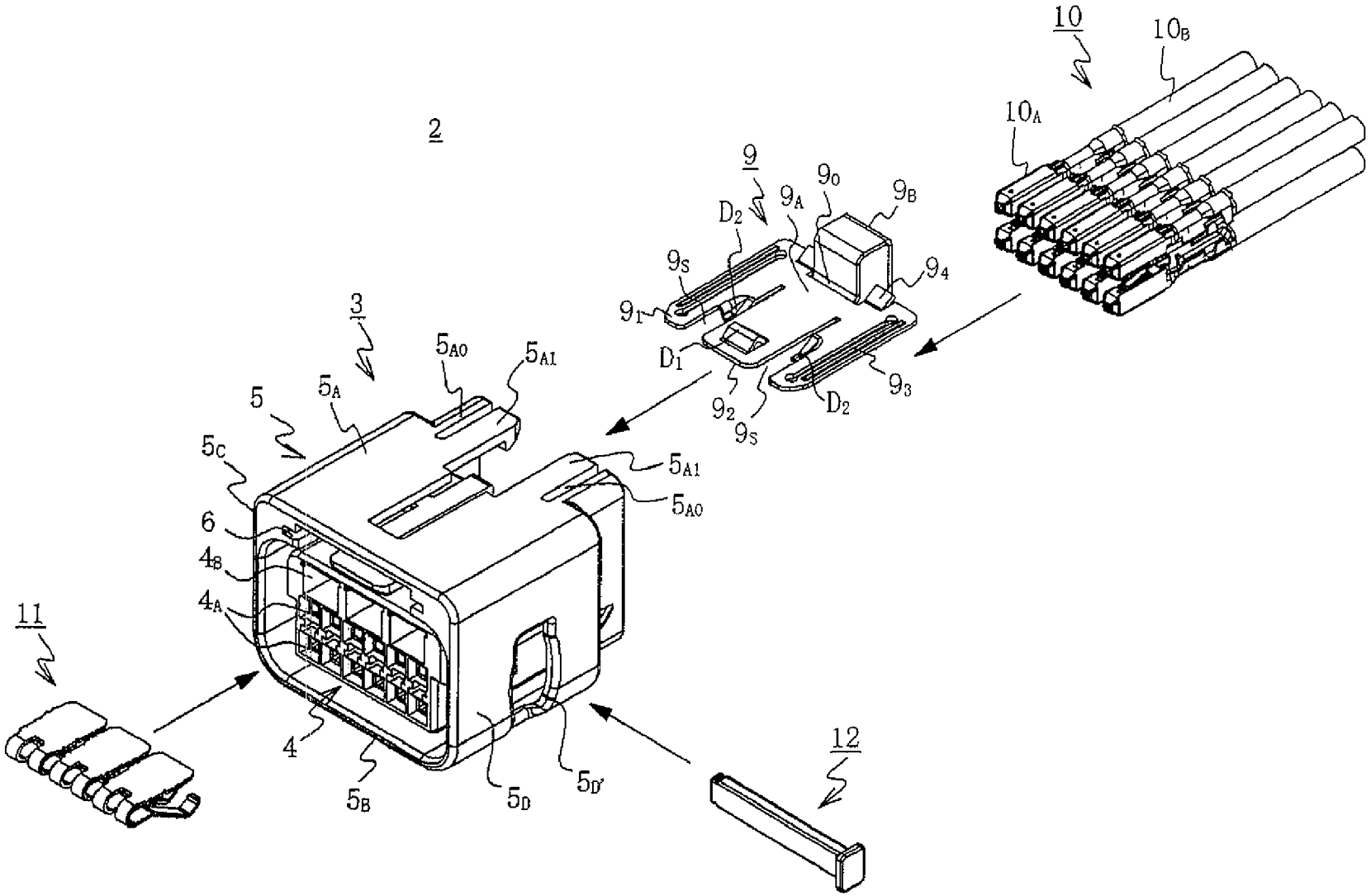
10
10A
10B
9
9A
9B
9O
9S
9T
9S
9S
9S

FIG.5
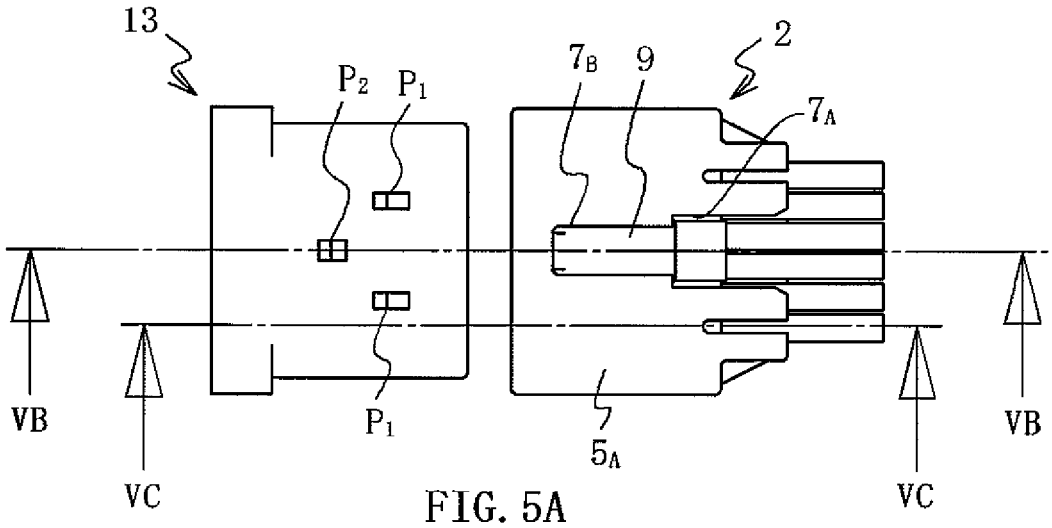
FIG. 5A
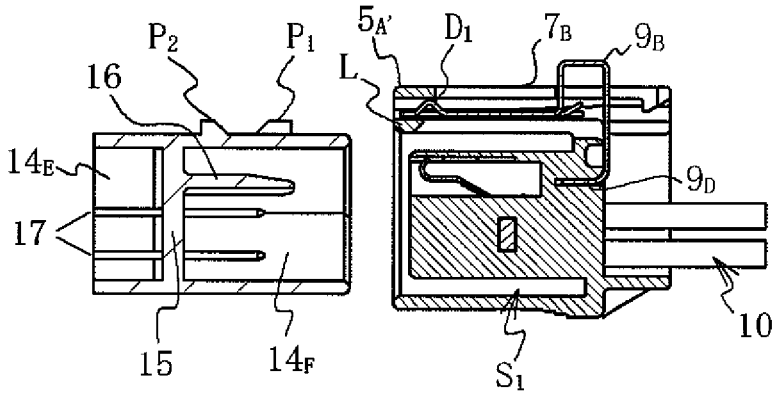
FIG. 5B
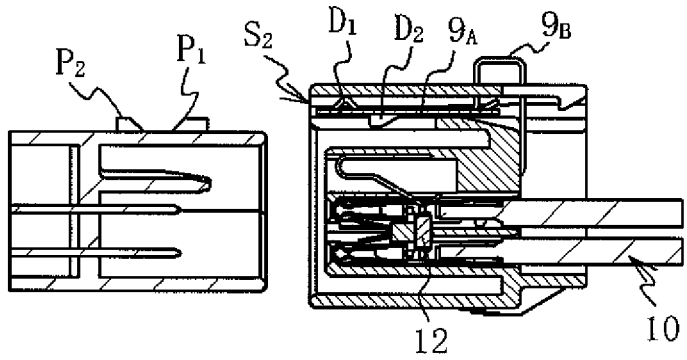
FIG. 5C

FIG.6
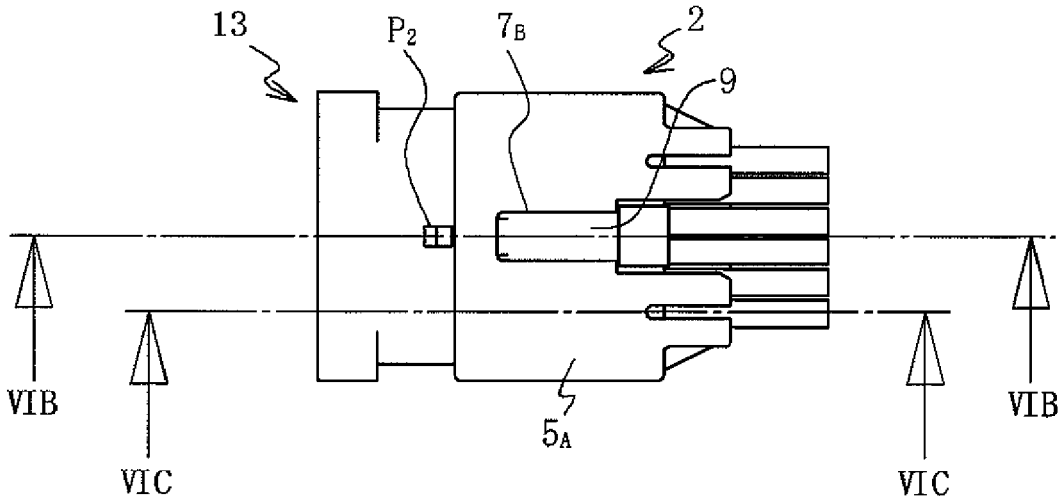
FIG. 6A
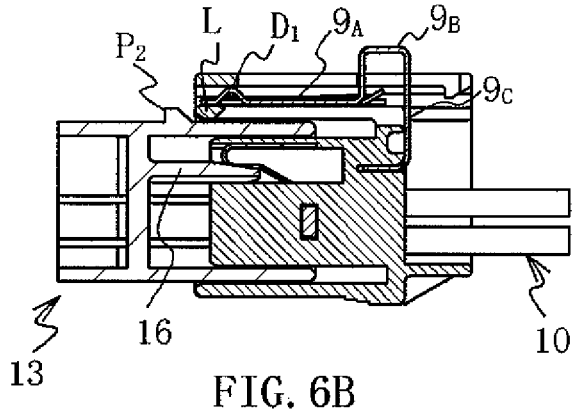
FIG. 6B
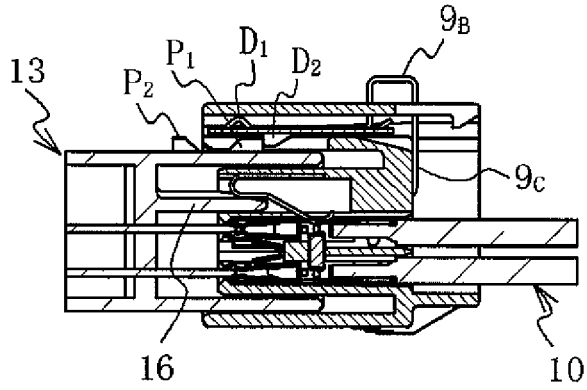
FIG. 6C

FIG.7
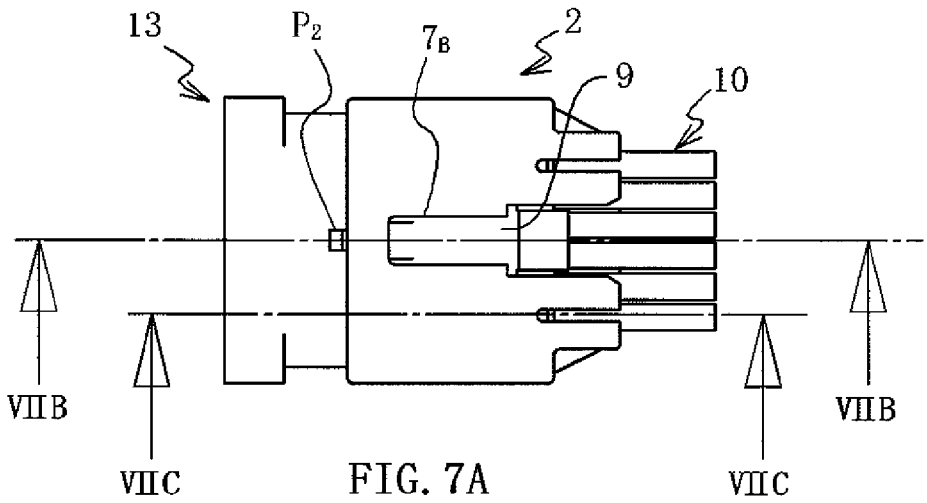
FIG. 7A
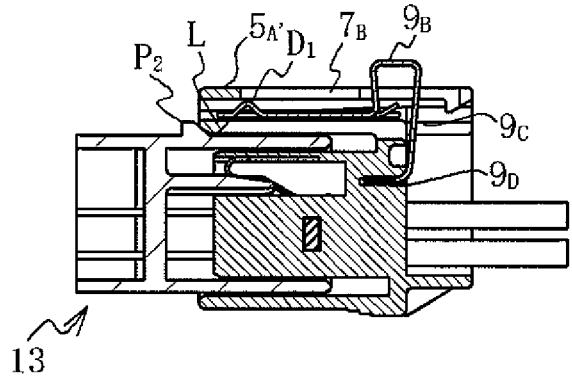
FIG. 7B
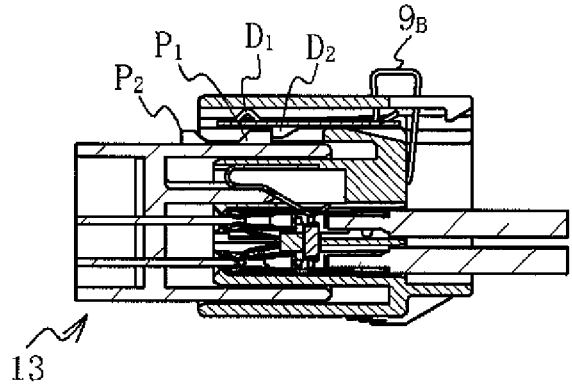
FIG. 7C

FIG.8
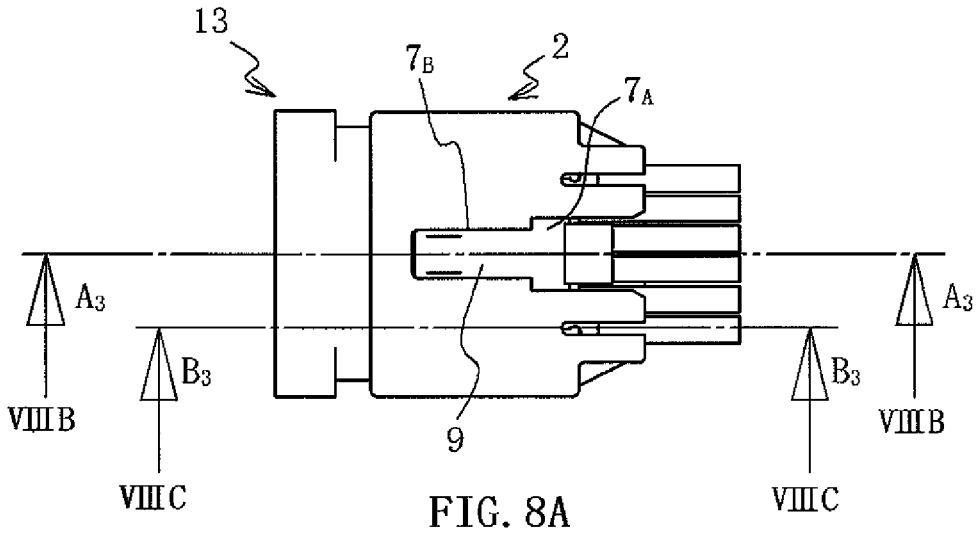
FIG. 8A
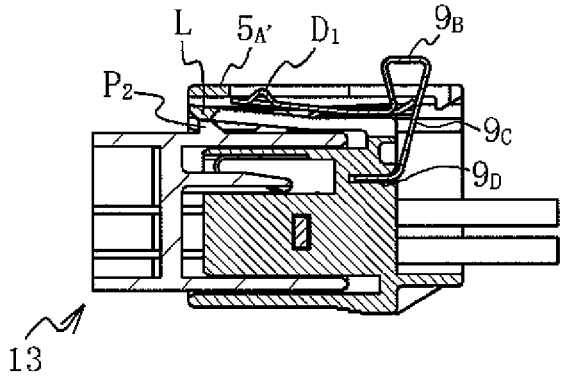
FIG. 8B
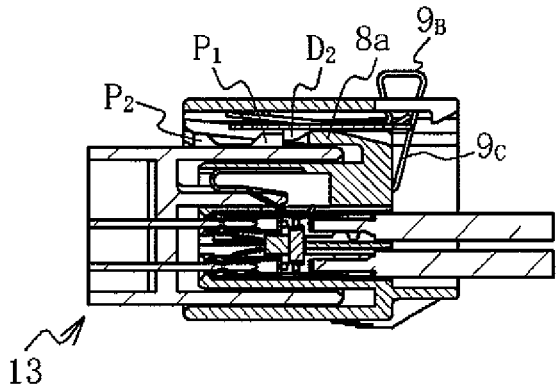
FIG. 8C

FIG.9
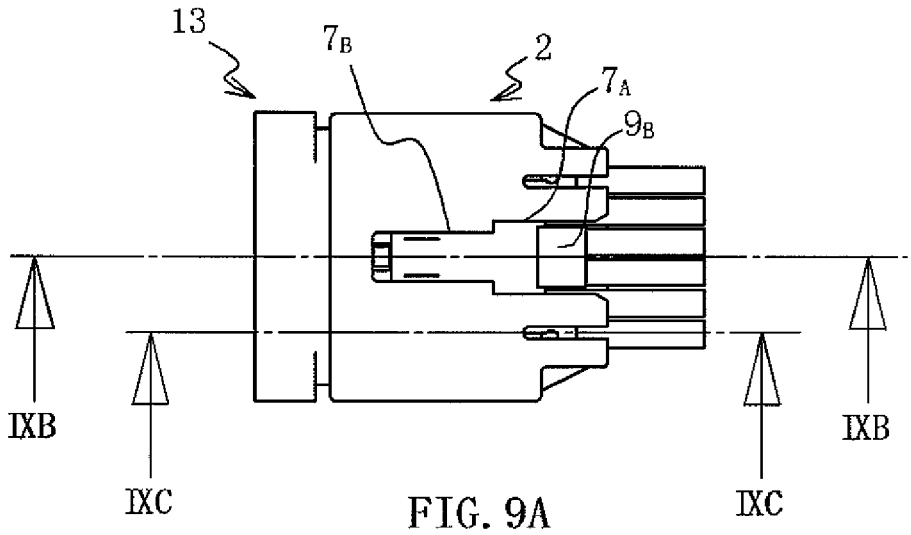
FIG. 9A
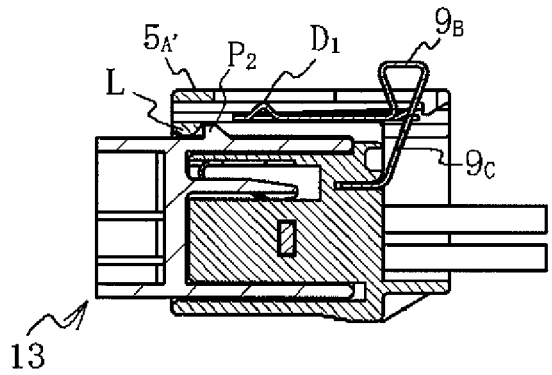
FIG. 9B
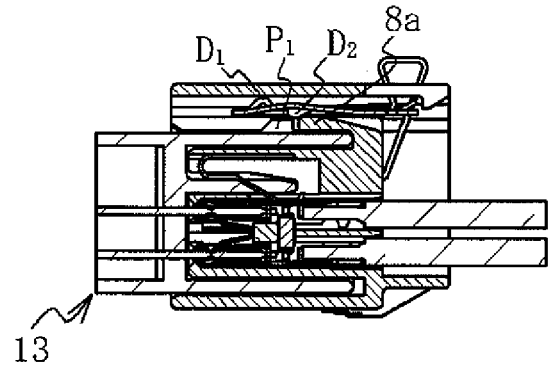
FIG. 9C

FIG.10
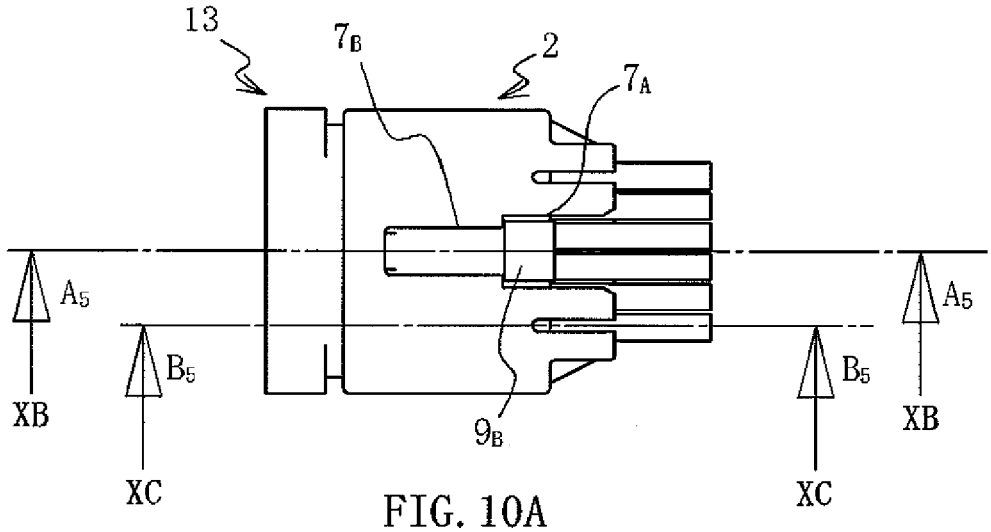
FIG. 10A
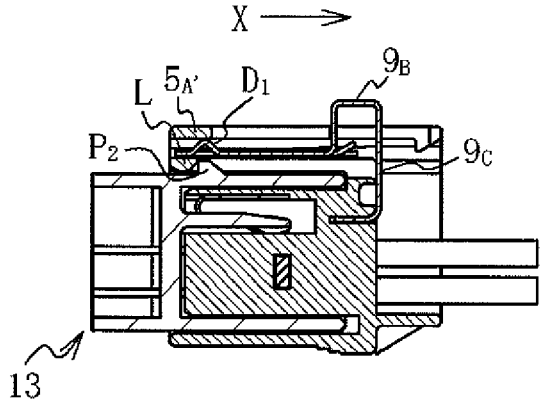
FIG. 10B
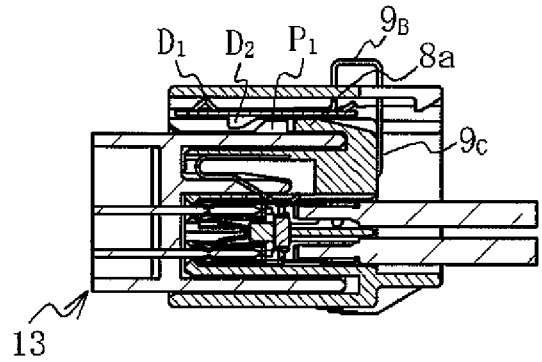
FIG. 10C

FIG.11
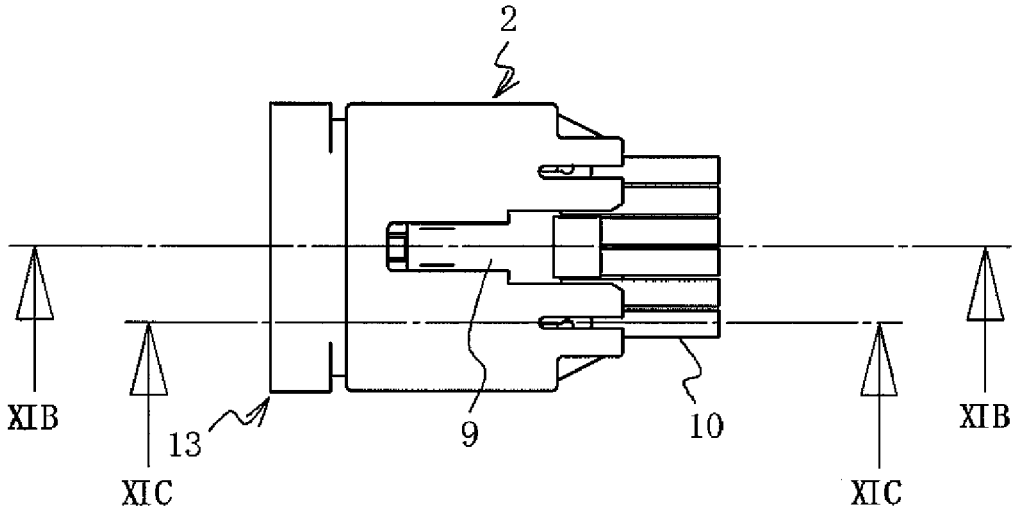
FIG. 11A
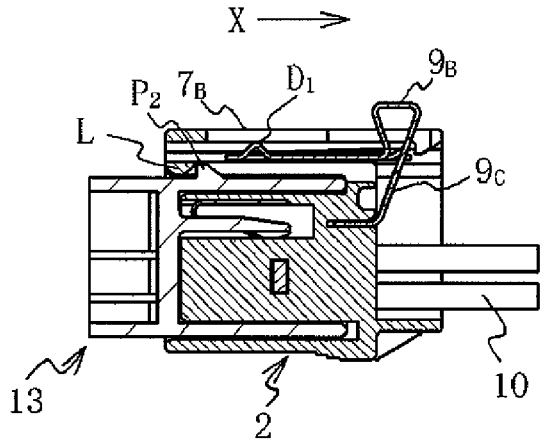
FIG. 11B
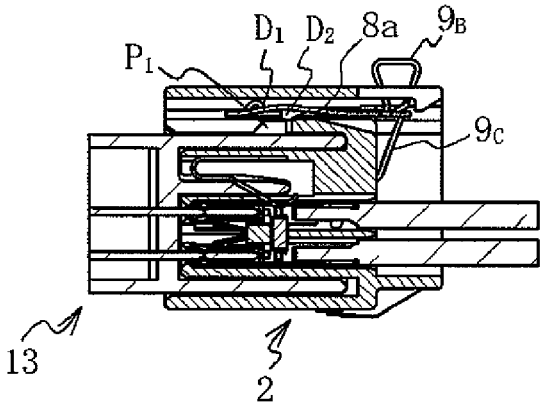
FIG. 11C

FIG.12
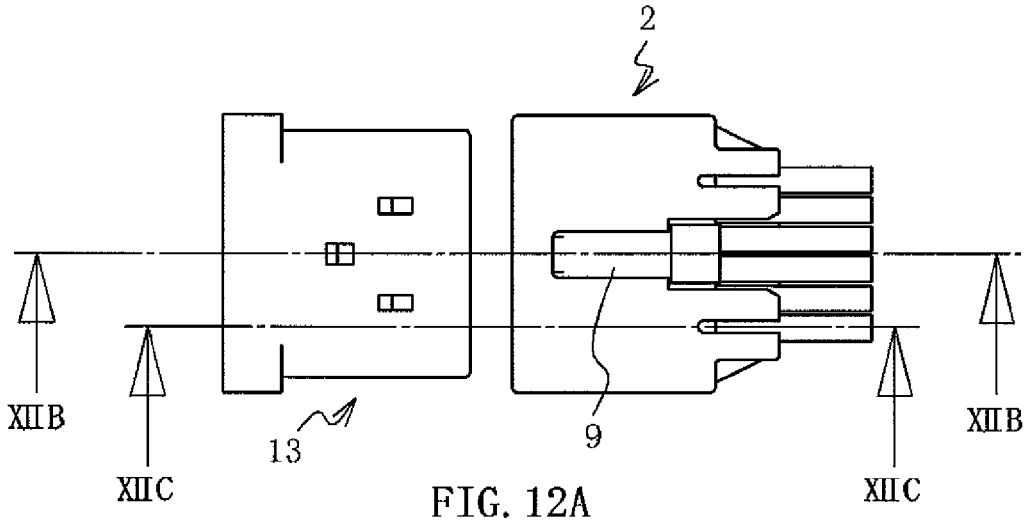
FIG. 12A
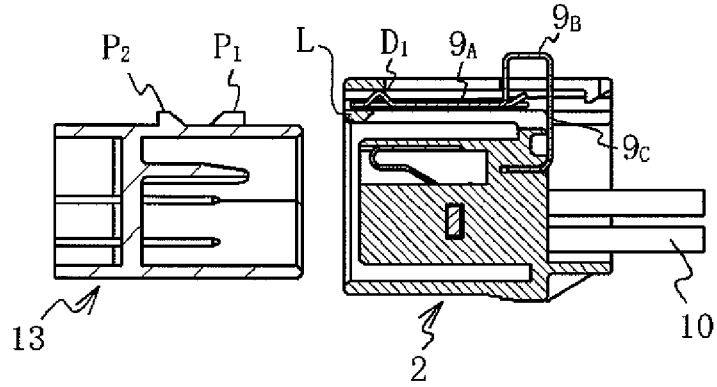
FIG. 12B
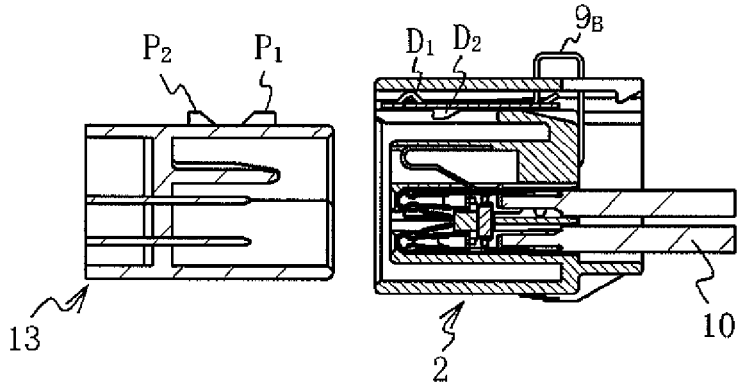
FIG. 12C (ralated art)

ELECTRICAL CONNECTOR

FIELD OF THE INVENTION

The present invention relates to an electrical connector including a male connector and a female connector. Particularly, the present invention relates to an electrical connector including a detecting means which can detect the fitted state of the both connectors.

BACKGROUND OF THE INVENTION

An electrical connector including a male connector and a female connector is generally provided with a locking means for preventing the both connectors connected to each other from being suddenly separated from each other. However, on the way to fitting the both connectors into each other, for example, in a half-fitted state, the contact terminals of the both connectors may become electrically connected to each other. In this case, since the connectors are connected without being locked by a latch means, the connection between the two connectors while being used may become suddenly disengaged. Therefore, there is known an electrical connector with a detecting means which detects the fitted state for preventing the connection in the half-fitted state.

For example, the electrical connector 20 disclosed in U.S. Pat. No. 6,186,819 includes, as shown in FIG. 13, a pair of first and second connectors 21, 24 fitted into each other. A latch pocket 21A is provided on one housing-wall surface of the first connector 21. A latch member 22 and a connector position assurance 23 (hereinafter, referred to as "CPA") are attached in the pocket 21A.

The latch member 22 has a pair of latch arms facing each other with a space therebetween, and a spring arm provided between the latch arms. The latch arms are connected to each other with a folded crossbeam at one end and with a finger lever at the other end. Protruding from this connection part, the spring arm is formed by blanking and bending the plate spring. The CPA 23 has shorter and longer wings protruding forward with a predetermined space therebetween from the both sides of the main body and a distal securing member protruding longer than the wings from a central part of the main body. The latch member is provided at the tip of the distal securing member.

The detection of the fitted state using the CPA 23 is performed as follows. The latch member 22 is attached to the latch pocket 21A of the first connector 21 beforehand and the first connector is inserted into the second connector. Then, the CPA 23 is inserted into a space of the latch member attached to the latch pocket 21A. It will be detected that the first connector and the second connector are completely fitted into each other when the CPA is inserted into the deepest position. The two connectors are in a half-fitted state when the insertion of the CPA is stopped halfway.

Further, PCT WO 2004/109866 and PCT WO 2004/095642 disclose an electrical connector with the following feature. On the upper face of a connector housing, an elastic lock arm is provided integrally with the connector housing. On the outer surface of the lock arm, a lock protrusion is provided. On the lower surface of the lock arm, a latch protrusion is provided. A CPA is inserted into a space of the lock arm.

With respect to any one of the electrical connectors disclosed in U.S. Pat. No. 6,186,819, PCT WO 2004/109866 and PCT WO 2004/095642, after the first and second connectors are fitted into each other, the CPA is attached to one connector to detect the fitted state of the two connectors. Accordingly, the actuation of the CPA is not linked with the fitting operation of the first and second connectors; the operation of detecting the fitted state is divided into the fitting operation of the connectors and the attaching operation of the CPA. Therefore, during the fitting step of the first and second connectors, the fitted state of the two connectors cannot be detected. When it has been found by attaching the CPA that the two connectors are in a half-fitted state, both the fitting operation of the two connectors and the attaching operation of the CPA are once again required, resulting in a cumbersome detecting operation.

The parts attached to a latch pocket of the electrical connector described in U.S. Pat. No. 6,186,819 include a latch member and a CPA. Since there are a large number of parts and the structure is complicated, the preparation of the parts is cumbersome and the attaching of the parts to the latch pocket is also cumbersome.

PCT WO 2004/109866 and PCT WO 2004/095642 describe an electrical connector with the following features. On the upper face of a connector housing, a flexible lock arm is provided integrally with the connector housing. On the outer surface of the lock arm, a lock protrusion is provided. On the lower surface of the lock arm, a latch protrusion is provided. A CPA is inserted into a space of the lock arm. Accordingly, the flexible lock arm for inserting the CPA needs to be provided on the upper face of the housing. Therefore, not only the form of the housing, but also the form of the mold for producing the connector becomes complicated, whereby the molding of the connector is cumbersome. Further, since the lock arm is provided integrally with the housing, the housing becomes larger, and consequently, the connector itself becomes larger. Moreover, since the CPA is inserted into the space of the lock arm, there is a problem in that the operation of the CPA becomes cumbersome not only while the first and second connectors are fitted into each other, but also when the two connectors are not fitted into each other, namely, are separated.

SUMMARY OF THE INVENTION

In consideration of the above-noted problem accompanying the related art, the present invention has an advantage to provide an electrical connector including a connector position assurance that detects the fitted state of a pair of connectors while the two connectors are fitted into each other.

Another advantage of the present invention is to provide an electrical connector in which a pair of connectors are automatically locked into each other by a connector position assurance while the two connectors are fitted into each other to secure the fitting of the two connectors.

Still another advantage of the present invention is to provide an electrical connector in which the fitting of the first and second connectors can be disengaged while the connector position assurance is attached to a connector housing.

Still another advantage of the present invention is to provide an electrical connector in which the connector position assurance is made as one part to lower cost and facilitate the attaching of the connector position assurance to the connector housing.

An electrical connector according to a first aspect of the present invention includes a first connector having a first connector housing with a first latch part on a peripheral wall surface of the first connector housing, a second connector having a second connector housing with a portion defining an inserting hole into which the first connector housing is fitted inside the second connector housing, and a connector position assurance for detecting a fitted state of the first and second connectors. The first latch part of the first connector includes a pair of a first latch protrusion and a second latch protrusion arranged with a space therebetween in a direction in which the first connector housing is fitted. The second connector includes an elastically deformable latch arm in the inserting hole of the second connector housing with a predetermined space from one inner wall surface of the second connector housing. The latch arm extends in a direction in which the second connector is fitted and has a latch pawl at an end of the elastic latch arm. The connector position assurance includes an elastically deformable first finger piece having a first bent protrusion at an end of the first finger piece, a second finger piece having a second bent protrusion at a position adjacent to the first finger piece and behind the first bent protrusion, a spring-force-accumulated part which is connected to the first and second finger pieces and is elastically deformed by push-in of the first and second finger pieces are fitted, and an attaching part extending from an end of the spring-force-accumulated part. The attaching part of the connector position assurance is fixed to the second connector housing, while the first and second finger pieces of the connector position assurance are fitted slidably in a fitted direction into a space between the elastic latch arm and the one inner wall surface. If the first and second connectors are fitted, the first latch protrusion of the first connector reaches the second bent protrusion of the connector position assurance to make the connector position assurance slide backward and to accumulate spring force in the spring-force-accumulated part. If a regular fitted state is achieved, the second latch protrusion latches onto the latch pawl of the elastic latch arm by means of spring recoil strength of the spring-force-accumulated part, and the first bent protrusion of the connector position assurance abuts the one inner wall surface to lock movement of the elastic latch arm.

In still another preferred aspect of the present invention, the first latch protrusion includes a pair of latch protrusions each of which is provided at either end of the second latch protrusion. One wall of the second connector housing facing the space has a portion defining a clearance groove which accommodates the first bent protrusion when the connector position assurance is pushed into the second connector housing. The latch pawl is provided toward the inserting hole. A deep part of the elastic latch arm has a disengaging part onto which the second bent protrusion mounts to disengage latching with the first latch protrusion.

The second finger piece of the connector position assurance includes a pair of second finger pieces each of which is provided at either end of the first finger piece.

In still another preferred aspect of the present invention, the spring-force-accumulated part of the connector position assurance has a curved part which is curved by push-in of the first and second finger pieces to accumulate spring force. The curved part protrudes from a wall surface of the second connector housing if the connector position assurance is fixed to the second connector housing of the second connector to serve as an operating part for separating the first and second connectors.

In still another preferred aspect of the present invention, the second bent protrusion of the connector position assurance includes a shoulder part which collides against the first latch protrusion, and a slide inclined surface that is inclined from the shoulder part at a predetermined angle.

In still another preferred aspect of the present invention, the connector position assurance is formed integrally with a metal plate spring.

In still another preferred aspect of the present invention, the second connector housing of the second connector includes an inner housing to which a contact terminal is attached, and an outer housing which covers an outer surrounding area of the inner housing except a front and rear part of the inner housing with a predetermined space between the inner and outer housings in which the elastic latch arm is provided.

In still another preferred aspect of the present invention, the elastic latch arm is made of a U-shaped arm piece whose bottom part is provided with the latch pawl, and the elastic latch arm extends from a rear wall of the second connector housing.

In still another preferred aspect of the present invention, the first latch protrusion of the first connector includes a shoulder part which collides against the second bent protrusion, and a slide inclined surface that is inclined from the shoulder part at a predetermined angle. The second latch protrusion has an inclined surface that slidingly contacts the latch pawl, and a shoulder part to be latched onto the latch pawl.

The present invention exhibits the following advantages from the above-noted features. According to the present invention, the attaching part of the connector position assurance is fixed to the second connector housing. When the first and second connectors are fitted into each other, the first connector is inserted into the second connector and by this inserting, the spring force is accumulated in the spring-force-accumulated part of the connector position assurance. When the first and second connectors have entered into a regular fitted state, by latching the second latch protrusion of the first connector onto the latch pawl of the elastic latch arm of the second connector through a spring recoil strength of the spring-force-accumulated part. Simultaneously, the first bent protrusion of the connector position assurance locks the movement of the elastic latch arm. Therefore, since the connector position assurance is actuated only by inserting the first connector into the second connector while the first and second connectors are fitted, the fitted state of the first and second connectors can be detected during the connecting operation of the two connectors. In other words, since the actuation of the connector position assurance is linked to the connecting operation of the first and second connectors, the connecting operation can be performed while confirming the fitted state of the two connectors. Therefore, according to the present invention, such a plurality of operations that after the first and second connectors have been connected to each other, the connector position assurance is attached to the connector and then, the fitted state is confirmed as in the related art, become unnecessary. Further, the first and second connectors can be easily separated by retreating the curved part of the connector position assurance. Moreover, since the connector position assurance is incorporated into the connector housing, the connector position assurance is not separated from the housing not only while the first and second connectors are fitted into each other, but also while the two connectors are separated, so that the management of the connector position assurance becomes easier.

Further, according to the present invention, since by producing each of the first latch protrusion of the first connector and the second bent protrusion of the connector position assurance as a pair of protrusions, the clearance groove is provided and consequently the first bent protrusion of the connector position assurance can move upward, the latching of the latch piece of the elastic latch arm onto the second latch protrusion can be smoothly performed. Moreover, by providing the disengaging part in a deep part of the elastic latch arm, the connector position assurance can move smoothly in the second connector housing while the first and second connectors are fitted so that the two connectors can be reliably latch-locked to each other.

Further, according to the present invention, the spring-force-accumulated part of the connector position assurance has the curved part which is curved by the push-in of the first and second finger pieces to accumulate spring force. The curved part protrudes from a wall surface of the housing when fixed to the second connector housing of the second connector and also functions as the operating part for separating the first and second connectors from each other, so that both the spring-force-accumulated part and the operating part can have a simple constitution.

Further, according to the present invention, since the second bent protrusion of the connector position assurance includes the shoulder part colliding against the first latch protrusion and the slide inclined surface that is inclined at a predetermined angle from the shoulder part, not only the shoulder part reliably abuts against the first latch protrusion to facilitate the retreat of the connector position assurance while the first and second connectors are fitted, but also the second bent protrusion can smoothly mount onto the disengaging part by the virtue of the slide inclined surface and the latch between the second bent protrusion and the first latch protrusion can be smoothly dissociated.

Further, according to the present invention, since the connector position assurance is produced integrally using a metal plate spring, the connector position assurance can be produced economically and easily. Further, since the connector position assurance has a simple form, also the housing to which the connector position assurance is attached can be produced in a simple form.

Further, according to the present invention, since the second connector housing of the second connector includes the inner housing and the outer housing, and the contact terminal can be attached in the inner housing, the contact terminal can be rigidly fixed. Further, since the elastic latch arm is provided in the space between the two housings, the elastic latch arm is not exposed out of the female connector housing and consequently the elastic latch arm is not damaged by the collision of an obstacle against it. Further, by providing the elastic latch arm in the space, the second connector housing can be miniaturized.

Further, according to the present invention, by producing the elastic latch arm as a U-shaped arm piece, the elastic latch arm can be produced integrally with the female connector housing by simple molding.

Further, according to the present invention, since each of the first and second latch protrusions includes the shoulder part and the inclined surface, the latching of the first and second latch protrusions onto the latch pawl and onto the second bent protrusion can be smoothly and reliably performed.

BRIEF DESCRIPTION OF THE DRAWINGS

FIG. 1 illustrates the state of an electrical connector including a male connector and a female connector before the fitting thereof; FIG. 1A is an external perspective view of the electrical connector in which the male connector comes to the front; and FIG. 1B is an external perspective view of the electrical connector in which the female connector comes to the front by rotating the electrical connector shown in FIG. 1A by 180°.

FIG. 2 is an exploded perspective view of the female connector shown in FIG. 1.

FIG. 5 illustrates the state of the female and male connectors before the fitting thereof; FIG. 5A is a plan view; FIG. 5B is a sectional view of FIG. 5A along the VB-VB line; and FIG. 5C is a sectional view of FIG. 5A along the VC-VC line.

FIG. 6 illustrates the state of the female and male connectors during the first step of the fitting thereof; FIG. 6A is a plan view; FIG. 6B is a sectional view of FIG. 6A along the VIB-VIB line; and FIG. 6C is a sectional view of FIG. 6A along the VIC-VIC line.

FIG. 7 illustrates the state of the female and male connectors during the second step of the fitting thereof, FIG. 7A is a plan view; FIG. 7B is a sectional view of FIG. 7A along the VIIB-VIIB line; and FIG. 7C is a sectional view of FIG. 7A along the VIIC-VIIC line.

FIG. 8 illustrates the state of the female and male connectors during the third step of the fitting thereof; FIG. 8A is a plan view; FIG. 8B is a sectional view of FIG. 8A along the VIIIB-VIIIB line; and FIG. 8C is a sectional view of FIG. 8A along the VIIIC-VIIIC line.

FIG. 9 illustrates the state of the female and male connectors during the fourth step of the fitting thereof; FIG. 8A is a plan view; FIG. 9B is a sectional view of FIG. 9A along the IXB-IXB line; and FIG. 9C is a sectional view of FIG. 9A along the IXC-IXC line.

FIG. 10 illustrates the state of the female and male connectors when the two connectors have been completely fitted into each other; FIG. 10A is a plan view; FIG. 10B is a sectional view of FIG. 10A along the XB-XB line; and FIG. 10C is a sectional view of FIG. 10A along the XC-XC line.

FIG. 11 illustrates the state of the female and male connectors during the first step of the separation thereof; FIG. 11A is a plan view; FIG. 11B is a sectional view of FIG. 11A along the XIB-XIB line; and FIG. 11C is a sectional view of FIG. 11A along the XIC-XIC line.

FIG. 12 illustrates the state of the female and male connectors when the two connectors have been separated from each other; FIG. 12A is a plan view; FIG. 12B is a sectional view of FIG. 12A along the XIIB-XIIB line; and FIG. 12C is a sectional view of FIG. 12A along the XIIC-XIIC line.

DESCRIPTION OF THE PREFERRED EMBODIMENTS

Figure 3:
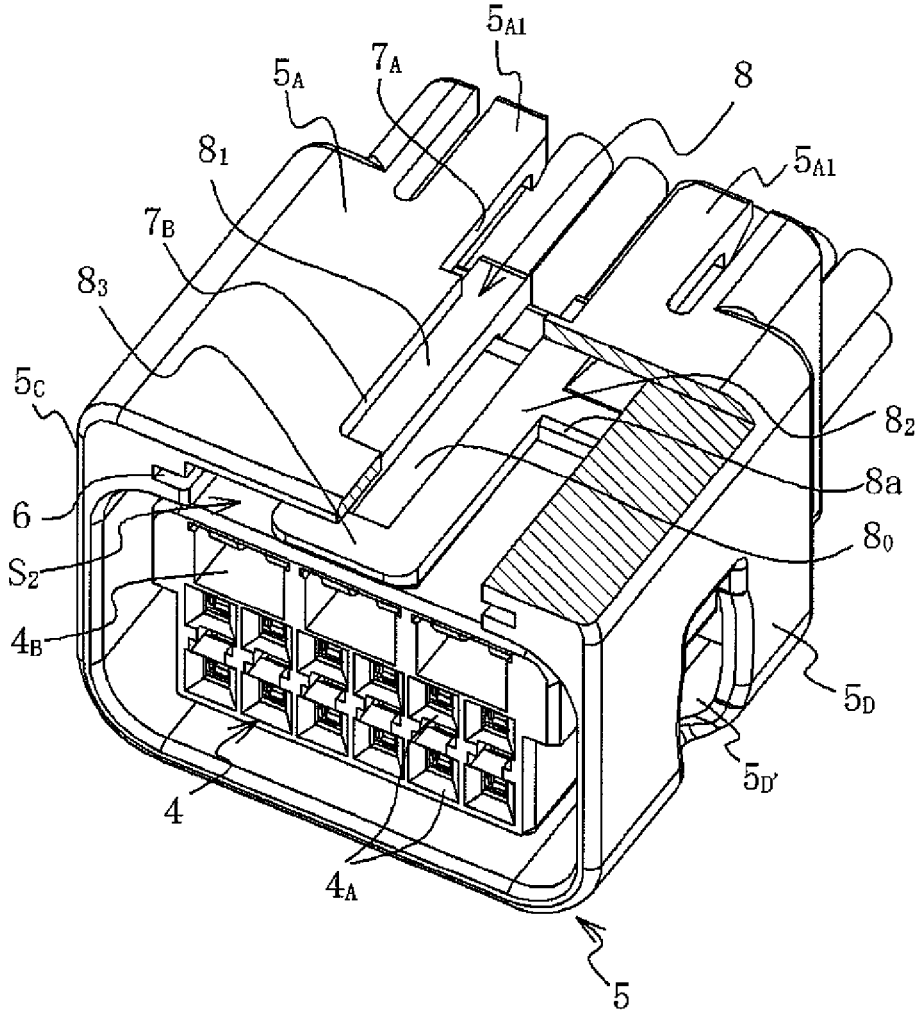
FIG. 3 is a perspective view of the female housing shown in FIG. 2 in which a part of its peripheral wall is cut off so that its inner side becomes visible.

Hereinafter, the best embodiments of the present invention are described referring to the drawings. However, the following embodiments only exemplify the electrical connector for embodying the technical concept of the present invention. Therefore, it is not intended to limit the scope of the present invention to these embodiments of the electrical connector, but other embodiments contained in the Claims are equally applicable.

First Embodiment

Figure 4:
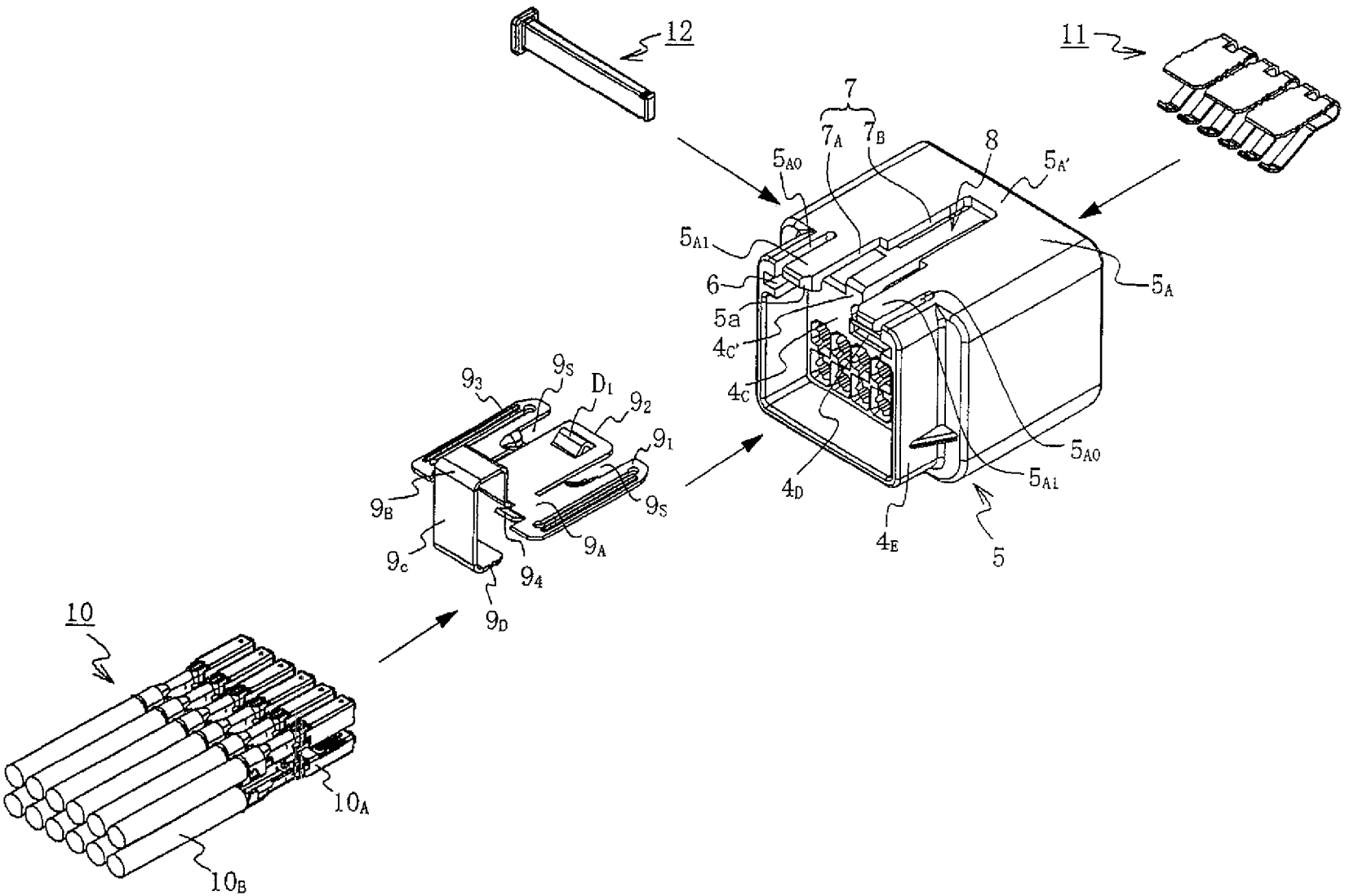
FIG. 4 is an exploded perspective view in which the female connector shown in FIG. 2 is rotated by 180°.
Figure 13:
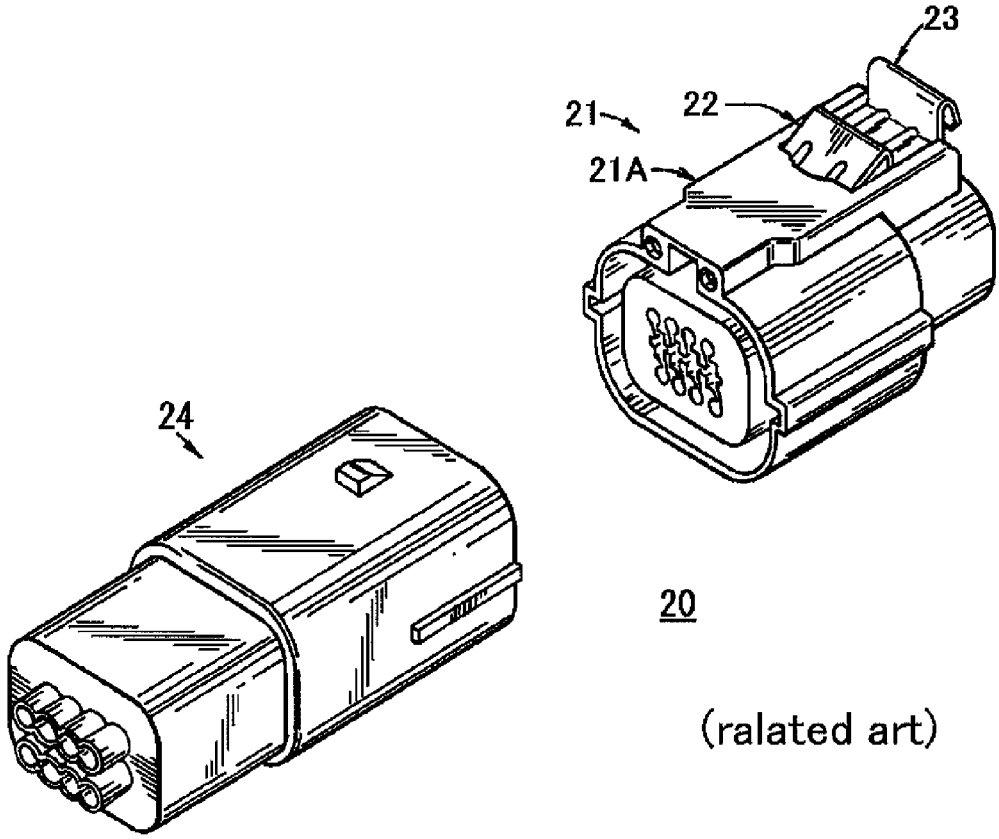
FIG. 13 is an external perspective view of an electrical connector according to the related art.

FIG. 1 illustrates the state of an electrical connector according to one embodiment of the present invention before the male connector and the female connector are fitted into each other; FIG. 1A is an external perspective view of the electrical connector in which the male connector comes to the front; and FIG. 1B is an external perspective view of the electrical connector in which the female connector comes to the front by rotating the electrical connector shown in FIG. 1A by 180°. FIG. 2 is an exploded perspective of the female connector of the electrical connector shown in FIG. 1. FIG. 3 is a perspective view of the female connector housing in which a part of its peripheral wall is cut off so that its inner side becomes visible. FIG. 4 is an exploded perspective view in which the female connector shown in FIG. 2 is rotated by 180°.

As shown in FIG. 1 to FIG. 3, the electrical connector 1 has the female connector 2 in which a plurality of the female contact terminals 10 are attached in the female connector housing (hereinafter, referred to as the female housing) 3 and the male connector 13 in which the male contact terminals 17 connected to the female contact terminals 10 are attached in the male connector housing (hereinafter, referred to as the male housing) 14, and in the female connector 2, the connector position assurance (CPA) 9 for detecting the fitted state of the female and male connectors 2 and 13 is attached in the female housing 3. Hereinafter, the female connector 2, the male connector 13 and the CPA 9 which constitute the electrical connector 1 are sequentially described.

As shown in FIG. 2 to FIG. 4, the female connector 2 has a plurality of the female contact terminals 10, the female housing 3 accommodating the female contact terminals 10, the CPA 9 attached in the female housing 3, the terminal position assurance (hereinafter, referred to as TPA) 12 and the short-circuit inspecting terminals (hereinafter, referred to as inspecting terminal) 11.

The female housing 3 has the inner housing 4 in which the female contact terminals 10 are attached and the outer housing 5 covering the surroundings of the inner housing 4 except the surroundings of the front and rear walls of the inner housing 4, wherein the inner housing 4 and the outer housing 5 are connected integrally to each other at the rear end wall of the two housings 4 and 5 while inserting a space of a predetermined size between them and the two housings are produced from an insulating resin molded article.

The inner housing 4 includes a rectangular solid block having a predetermined width, height and depth and in the inner housing 4, a plurality of the attaching holes $\mathbf{4}_A$ and $\mathbf{4}_B$ for attaching a plurality of female contact terminals 10 and inspecting terminals 11 are provided in the longer direction of the housing from a front part to a rear part. The attaching holes $\mathbf{4}_A$ in which the female contact terminals 10 are attached are arranged in two stages of an upper stage and a lower stage, and each of the attaching holes $\mathbf{4}_A$ penetrates the inner housing 4. One stage of the attaching holes $\mathbf{4}_B$ in which the inspecting terminals 11 are attached is arranged over the two stages of the attaching holes $\mathbf{4}_A$ and the attaching holes $\mathbf{4}_B$ do not penetrate the inner housing 4. The rear terminals of the attaching holes $\mathbf{4}_B$ are closed up by the rear wall $\mathbf{4}_C$ (see FIG. 4). Further, on a side wall of the inner housing 4, an attaching hole into which the TPA 12 is inserted is provided. The TPA 12 is inserted through the helical groove $\mathbf{5}_{D'}$ of the outer housing 5.

As shown in FIG. 4, on the rear wall $\mathbf{4}_C$ of the inner housing 4, the attaching groove $\mathbf{4}_D$ to which the attaching part $\mathbf{9}_D$ of the CPA 9 is fixed is provided over the attaching hole $\mathbf{4}_A$. Further, from one end edge $\mathbf{4}_{C'}$ of the rear wall $\mathbf{4}_C$, the approximate U-shaped elastic latch arm 8 having a length of from the end edge $\mathbf{4}_{C'}$ to one end edge of the front wall is extended from the rear wall $\mathbf{4}_C$ which is bent at the end edge $\mathbf{4}_C$ toward the front wall of the inner housing 4. As shown in FIG. 3, the elastic latch arm 8 includes a pair of the arm pieces $\mathbf{8}_1$, $\mathbf{8}_2$ facing each other via the space $\mathbf{8}_0$, and the connecting piece $\mathbf{8}_3$ connecting the terminals of the arm pieces $\mathbf{8}_1$, $\mathbf{8}_2$ to each other. These arm pieces and connecting piece form together an approximate U-shape and are provided by producing integrally as one molded article. Further, from the side parts of the arm pieces $\mathbf{8}_1$, $\mathbf{8}_2$ of the elastic latch arm 8, respectively, the beam parts $\mathbf{8}_a$, $\mathbf{8}_a$ are provided as branch parts of the elastic latch arm 8 which extend respectively to the side walls $\mathbf{5}_C$, $\mathbf{5}_D$ of the outer housing 5 (in FIG. 3, the beam part $\mathbf{8}_a$ of the arm piece $\mathbf{8}_1$ is hidden by the upper peripheral wall $\mathbf{5}_A$ of the outer housing 5). Onto these beam parts $\mathbf{8}_a$, $\mathbf{8}_a$, respectively, the second bent protrusions $D_2$, $D_2$ of the connector position assurance 9 mount. These beam parts function as disengaging protrusions for disengaging the latching of the second bent protrusion onto the first latch protrusion $P_1$.

On the connecting piece $\mathbf{8}_3$ of the elastic latch arm 8, the latch pawl L protruding toward the upper wall surface of the inner housing 4 is provided (see FIG. 5). Further, the frame $\mathbf{4}_E$ having a hollow and a predetermined width protrudes from the periphery of the rear wall $\mathbf{4}_C$ and functions as a cover of a lead wire connected to the female contact terminal 10 (see FIG. 4). As shown in FIGS. 2 and 4, the female contact terminal 10 includes the female contact $\mathbf{10}_A$ and the lead wire $\mathbf{10}_B$ connected to the female contact $\mathbf{10}_A$.

The outer housing 5 has the peripheral walls $\mathbf{5}_A$-$\mathbf{5}_D$ covering the surroundings of the inner housing 4 except the surroundings of the predetermined spaces $S_1$, $S_2$, and an opening thereof is provided in the form of a rectangular cylinder. As shown in FIG. 5, the space $S_1$ has a width and length sufficient for inserting the male housing 14 thereinto, and the space $S_2$ is provided at a position higher than that of the space $S_1$ in the height direction shown in FIG. 5. In the space $S_2$, the sliding groove 6 into which the CPA 9 is inserted and can move by sliding is provided on the both side walls in the longer direction at a position higher than that of the elastic latch arm 8. The sliding groove 6 is provided throughout the longer direction of the outer housing 5 (see FIG. 3 and FIG. 4). As described above, on one side wall $\mathbf{5}_D$ of the outer housing 5, the helical groove $\mathbf{5}_{D'}$ for inserting the TPA 12 is provided.

As shown in FIG. 4, in the outer housing 5, a part of the peripheral wall $\mathbf{5}_A$ in which the elastic latch arm 8 is provided is notched from the rear part toward the front part to provide the accommodating groove 7 for accommodating a part of the CPA 9. By the accommodating groove 7, the peripheral wall $\mathbf{5}_A$ is divided into the right part and the left part which are, however, partially connected to each other through the connecting part $\mathbf{5}_{A''}$. The accommodating groove 7 consists of the narrow-width groove $\mathbf{7}_B$ positioned in the front part and the wide-width groove $\mathbf{7}_A$ positioned in the rear part, and the wide-width groove $\mathbf{7}_A$ has an opening at the rear end. During the attaching of the CPA 9, the curved part $\mathbf{9}_B$ of the CPA is inserted into the wide-width groove $\mathbf{7}_A$ and the first bent protrusion $D_1$ is inserted into the narrow-width groove $\mathbf{7}_B$. This narrow-width groove $\mathbf{7}_B$ functions as the clearance groove $\mathbf{7}_B$ for the first bent protrusion $D_1$. Further, in the both sides of the wide-width groove $\mathbf{7}_A$, the elastic latch arms $\mathbf{5}_{A1}$, $\mathbf{5}_{A1}$ are provided. These latch arms $\mathbf{5}_{A1}$, $\mathbf{5}_{A1}$ are respectively isolated by the slits $\mathbf{5}_{A0}$, $\mathbf{5}_{A0}$ provided in the side parts of the peripheral wall $\mathbf{5}_A$ to form the elastic pieces. The latch pawls 5*a*, 5*a* are provided respectively on the under surfaces of the latch arms $\mathbf{5}_{A1}$, $\mathbf{5}_{A1}$ at the rear ends of the latch arms $\mathbf{5}_{A1}$, $\mathbf{5}_{A1}$. Onto these latch pawls 5*a*, 5*a*, respectively the latch pieces $\mathbf{9}_4$, $\mathbf{9}_4$ of the CPA 9 are latched.

As shown in FIGS. 2 and 4, the CPA 9 includes: the approximately-rectangular plate part $\mathbf{9}_A$; the curved part $\mathbf{9}_B$ which is provided in such a manner that the curved part $\mathbf{9}_B$ having a predetermined width, first rises upright from the base part $\mathbf{9}_0$ which is an approximately-central part of one side of the plate part $\mathbf{9}_A$, second extends horizontally for a predetermined distance, third falls vertically, and totally is curved; and the attaching part $\mathbf{9}_D$ which is provided in such a manner that the attaching part $\mathbf{9}_D$ is extended horizontally from the terminal of the curved part $9_B$ in the direction approaching the plate part $9_A$, and the CPA 9 is produced by blanking and bending a relatively thin-walled plate-shaped spring made of metal. Further, the part provided by extending the curved part $9_B$ downward vertically is a relatively longer plate as the side plate part $9_C$ to which elasticity is imparted. Further, with respect to the attaching part $9_D$, on the side surface or the like thereof, the slip-off stop is processed for preventing the slip-off thereof when the attaching part $9_D$ is fixed to the female housing 3.

In the plate part $9_A$, the slit grooves $9_S$, $9_S$ are provided respectively in the near of the both ends in the width direction in such a manner that the slit grooves $9_S$, $9_S$ are extended respectively from one side opposite to the side where the curved part $9_B$ is provided, toward the base part $9_0$, so that the plate part $9_A$ is divided by the slit grooves $9_S$, $9_S$ into three pieces of the divided pieces $9_1$ to $9_3$. With respect to the divided pieces $9_1$ to $9_3$, hereinafter, the central divided piece $9_2$ is referred to as a first finger piece and the divided pieces $9_1$, $9_3$ on the both sides are referred to as second finger pieces. The first finger piece $9_2$ has a larger width than that of the second finger pieces $9_1$, $9_3$. Since the first finger piece $9_2$ is isolated by the slit grooves $9_S$, $9_S$, when the front part thereof is pressed toward the rear part, the first finger piece $9_2$ is flexurally deformed and flexible. The slit grooves $9_S$, $9_S$ change the width thereof on the way from the front part toward the base part $9_0$, so that the slit grooves $9_S$, $9_S$ consist of a narrow-width part and a wide-width part. In the connection part between the narrow-width part and the wide-width part, the second bent protrusions $D_2$, $D_2$ are provided while being depressed downward and the second bent protrusions $D_2$, $D_2$ have the same form as each other. As shown in FIGS. 2 and 5 C, the second bent protrusions $D_2$, $D_2$ respectively include the shoulder part pending from the plate part $9_A$ and the slide inclined surface that is inclined from the shoulder part toward the plate part $9_A$ at a predetermined angle. With respect to the shoulder part and the slide inclined surface, the shoulder part collides against the first latch protrusion $P_1$ and the slide inclined surface mounts onto the beam parts 8*a*, 8*a* of the elastic latch arm 8 while the female connector 2 and the male connector 13 are fitted.

On the first finger piece $9_2$ around a leading edge part thereof, the first latch protrusion $D_1$ protruding upward is provided. The first latch protrusion $D_1$ is in the form of a mountain having a top part having a predetermined height and the top part abuts the inner wall surface of the connecting part $5_{A'}$ of the peripheral wall $5_A$ in the space $S_2$ of the female housing 3. Before the fitting of the female connector 2 and the male connector 13, the top part presses the elastic latch arm 8 downward to restrict the upward movement thereof. Further, the latch pieces $9_4$, $9_4$ which are respectively cut and raised upward are provided in the both sides of the curved part $9_B$ rising upright from the base part $9_0$.

As shown in FIGS. 7 to 9, the curved part $9_B$ is provided as a spring-force-accumulated part produced by curving into an approximate U-shape to accumulate a spring force therein when the first and second finger pieces $9_2$, $9_1$, $9_3$ are pressed rearward. The curved part $9_B$ functions also as an operating part which can be moved by hand. The attaching part $9_D$ is bent into an approximate L-shape from the curved part $9_B$ toward the plate part $9_A$ and the resultant bent part is fixed into the attaching groove $4_D$ of the inner housing 4 by press-fitting.

As shown in FIG. 2, the assembling of the female connector 2 is performed as follows. First, a plurality of the female contact terminals 10 are inserted respectively into each of the attaching holes $4_A$ from the rear part of the female housing 3 and the TPA 12 is inserted through the helical groove $5_{D'}$ of the outer housing 5, thereby positioning and fixing each of the contact terminals 10 in the housing 3. Further, the inspecting terminals 11 are inserted into the attaching holes $4_B$ from the front part of the female housing 3. By attaching the inspecting terminals 11, for example as shown in FIG. 5A, the fitting terminals 11 are electrically connected with a part of the periphery of each of the contact terminals 10 through the holes of the attaching holes $4_B$. Thereafter, from the rear part of the female housing 3, a pair of the second finger pieces $9_1$, $9_3$ of the CPA 9 are inserted into the sliding groove 6 and the latch pawls $5_a$, $5_a$ provided respectively on the latch arms $5_{A1}$, $5_{A1}$ are latched onto the latch pieces $9_4$, $9_4$ of the CPA 9, thereby fixing CPA 9. By this fixing of the CPA 9, the curved part $9_B$ of the CPA 9 protrudes from the wall surface of the outer housing 5, thereby completing the assembling of the female connector 2.

As shown in FIG. 1, the male connector 13 is in the form of a cylinder having such a size that the male connector 13 can be inserted into the space $S_1$ between the inner housing 4 and outer housing 5 of the female housing 3 and is produced using an insulating synthetic resin. In other words, the male connector 13 has the peripheral walls $14_A$-$14_D$ in every side and the front and rear openings $14_E$, $14_F$ which are in the form of a rectangular cylinder, and the partition 15 is provided in the inside of the male connector 13 (see FIG. 5).

As shown in FIG. 5, the attaching holes in which a plurality of the male contacts 17 are attached are provided on the partition 15. Further, from the partition 15, the actuating bar 16 which abuts the inspecting terminals 11 while the female and male connectors 2, 13 are fitted to disengage the contact of the inspecting terminals 11 with the female contact terminals 10, protrudes toward the fitting direction of the two connectors 2, 13. In the male housing 14, three latch protrusions $P_1$, $P_1$, $P_2$ are provided on one of the peripheral walls thereof, more specifically on the upper peripheral wall $14_A$ shown in FIG. 1.

These latch protrusions $P_1$, $P_1$, $P_2$ consist of a pair of the latch protrusions $P_1$, $P_1$ (hereinafter, referred to as the first latch protrusion) and the latch protrusion $P_2$ positioned between the two latch protrusions $P_1$, $P_1$ (hereinafter, referred to as the second latch protrusion). The first latch protrusions $P_1$, $P_1$ are arranged in a front part in the fitting direction and the second latch protrusion $P_2$ is arranged in a more rear part than that of the first latch protrusions $P_1$, $P_1$. Each of the first and second latch protrusions $P_1$, $P_1$, $P_2$ is a protrusion in the form of a rectangular solid having an incline (slide inclined surface) as one side wall thereof; however, the inclined surface of the latch protrusion $P_1$ turns to a direction formed by rotating by 180° a direction to which the inclined surface of the latch protrusion $P_2$ turns.

The latch protrusions $P_1$, $P_1$, $P_2$ include respectively a shoulder part protruding upright from the surface of the upper peripheral wall $14_A$ of the male housing 14, a top flat part, and a slide inclined surface that is inclined downward at a predetermined angle from the top flat part to the surface of the upper peripheral wall $14_A$. The shoulder part of the first latch protrusion $P_1$ turns to the jack of the male housing 14 and on the contrary, the shoulder part of the second latch protrusion $P_2$ turns to the rear end of the male housing 14. By producing the first and second latch protrusions $P_1$, $P_2$ in the above-noted form, the CPA 9 can smoothly collide against or run onto the second bent protrusions $D_2$, $D_2$ or the like.

Next, referring to FIGS. 5-10, the fitting of the female connector 2 and the male connector 13, and the function of the CPA 9 are described. FIG. 5 illustrates the state of the female and male connectors before the fitting thereof; FIG. 5A is a plan view; FIG. 5B is a sectional view of the two connectors shown in FIG. 5A along the VB-VB line; and FIG. 5C is a sectional view of the two connectors shown in FIG. 5A along the VC-VC line. FIG. 6 illustrates the state of the female and male connectors during the first step of the fitting thereof; FIG. 6A is a plan view; FIG. 6B is a sectional view of the two connectors shown in FIG. 6A along the VIB-VIB line; and FIG. 6C is a sectional view of the two connectors shown in FIG. 6A along the VIC-VIC line. FIG. 7 illustrates the state of the female and male connectors during the second step of the fitting thereof; FIG. 7A is a plan view; FIG. 7B is a sectional view of the two connectors shown in FIG. 7A along the VIIB-VIIB line; and FIG. 7C is a sectional view of the two connectors shown in FIG. 7A along the VIIC-VIIC line. FIG. 8 illustrates the state of the female and male connectors during the third step of the fitting thereof; FIG. 8A is a plan view; FIG. 8B is a sectional view of the two connectors shown in FIG. 8A along the VIIIB-VIIIB line; and FIG. 8C is a sectional view of the two connectors shown in FIG. 8A along the VIIIC-VIIIC line. FIG. 9 illustrates the state of the female and male connectors during the fourth step of the fitting thereof; FIG. 8A is a plan view; FIG. 9B is a sectional view of the two connectors shown in FIG. 9A along the IXB-IXB line; and FIG. 9C is a sectional view of the two connectors shown in FIG. 9A along the IXC-IXC line. FIG. 10 illustrates the state of the female and male connectors when the two connectors have been completely fitted into each other; FIG. 10A is a plan view; FIG. 10B is a sectional view of the two connectors shown in FIG. 10A along the XB-XB line; and FIG. 10C is a sectional view of the two connectors shown in FIG. 10A along the XC-XC line.

As shown in FIG. 5, before the fitting of the female connector 2 and the male connector 13, the CPA 9 is in the space $S_2$ of the female connector 2 and the first bent protrusion $D_1$ of the CPA 9 is positioned between the elastic latch arm 8 and the inner wall surface of the connecting part $\mathbf{5}_{A'}$ of the outer housing 5. The top part of the first bent protrusion $D_1$ abuts the inner wall surface (see FIG. 5B).

In the above-noted state, when the male connector 13 is inserted into the female connector 2, as shown in FIG. 6, at the beginning of the inserting, a pair of the first latch protrusions $P_1$, $P_1$ of the male connector 13 collide against respectively the second bent protrusions $D_2$, $D_2$ of the CPA 9 (see FIG. 6C). When the male connector 13 is further pushed into the female connector 2, as shown in FIG. 7, each of the first latch protrusions $P_1$, $P_1$ of the male connector 13 retreats respectively each of the second bent protrusions $D_2$, $D_2$ of the CPA 9 further backward and not only pushes the curved part $\mathbf{9}_B$ of the CPA 9, but also narrows the U-shaped space a little. At this time, the side plate part $\mathbf{9}_C$ departs from the surface of the rear wall $\mathbf{4}_C$ and the spring force is accumulated also in the side wall part $\mathbf{9}_C$. By this push-in of the curved part $\mathbf{9}_B$, the abutment of the first bent protrusion $D_1$ of the CPA 9 and the inner wall surface of the connecting part $\mathbf{5}_{A'}$ on each other is disengaged and the first bent protrusion $D_1$ is moved into the clearance groove $\mathbf{7}_B$. Thus, the restriction of the moving of the first finger piece $\mathbf{9}_2$ of the CPA 9 is removed and the first finger piece $\mathbf{9}_2$ becomes able to be lifted upward (see FIG. 7B). In this state, the second latch protrusion $P_2$ collides against the latch pawl L of the elastic latch arm 8.

When the male connector 13 is further pushed into the female connector 2, as shown in FIG. 8, the second latch protrusion $P_2$ pushes up the latch pawl L of the elastic latch arm 8 upward. By this pushing-up, the elastic latch arm 8 is curved upward and accordingly, the first finger piece $\mathbf{9}_2$ of the CPA 9 which has become able to be lifted upward is also lifted upward (see FIG. 8B). On the other hand, the second bent protrusion $D_2$ of the CPA 9 is retreated further backward by the first latch protrusions $P_1$ and abuts the beam part 8*a* of the elastic latch arm 8 to be lifted upward making use of the inclined surface thereof (see FIG. 8C). In this state, the side plate part $\mathbf{9}_C$ departs further from the surface of the rear wall $\mathbf{4}_C$ and the spring force is accumulated also in the side wall part $\mathbf{9}_C$.

Next, when the male connector 13 is still further pushed into the female connector 2, as shown in FIG. 9, the second bent protrusion $D_2$ of the CPA 9 mounts onto the beam part 8*a* of the elastic latch arm 8 and the abutment of the first latch protrusion $P_1$ and the second bent protrusion $D_2$ on each other is disengaged. The curved part $\mathbf{9}_B$ of the CPA 9 is restored by the accumulated spring force (see FIG. 9C). On the other hand, the second latch protrusion $P_2$ pushes up the latch pawl L of the elastic latch arm 8 upward and is latched onto the latch pawl L (see FIG. 9B). Thereafter, when the CPA 9 is returned to the original position by the spring recoil strength of the curved part $\mathbf{9}_B$, as shown in FIG. 10, the first bent protrusion $D_1$ gets into the space of the connecting part $\mathbf{5}_{A'}$ and the top part of the first bent protrusion $D_1$ abuts the inner wall surface of the peripheral wall $\mathbf{5}_A$ (see FIG. 10B), so that the slip-off of the second latch protrusion $P_2$ is restricted by the second bent protrusion $D_2$. Thus, the connection of the female connector 2 with the male connector 13 is locked.

According to this electrical connector 1, by incorporating the CPA 9 into the female connector 2 beforehand and only by connecting the male connector 13 to the female connector 2, when the two connectors 2, 13 are fitted completely into each other, the fitted state of the two connectors 2, 13 is automatically locked by the CPA 9, so that the detection of the fitted state becomes extremely easy. In other words, when the male connector is fitted into the female connector, by pushing the male connector into the female connector during the fitting, the CPA 9 is elastically deformed and is allowed to be pushed into further, and when the two connectors are completely fitted into each other, the CPA 9 is returned into the original state by the spring recoil strength of itself so that the fitted state of the two connectors is locked. Therefore, the double operation in which after the two connectors have been fitted into each other, the CPA is attached thereto to detect the fitted state as in the related art, is unnecessary and the fitted state can be extremely easily detected. Further, since the CPA 9 has a simple constitution in which the slit groove $\mathbf{9}_S$, the first and second bent protrusion $D_1$, $D_2$ and the like are provided, the CPA 9 can be produced in low cost and easily. Further, since the form of the CPA 9 is simple, the form of the female housing 3 to which the CPA 9 is attached becomes also simple.

Next, referring to FIGS. 11 and 12, the separating method of the female connector 2 and the male connector 13 is described. FIG. 11 shows the first step of the separation of the female and male connectors; FIG. 11A is a plan view; FIG. 11B is a sectional view of FIG. 11A along the XIB-XIB line; and FIG. 11C is a sectional view of FIG. 11A along the XIC-XIC line. FIG. 12 shows the state of the female and male connectors which have been separated from each other; FIG. 12A is a plan view; FIG. 12B is a sectional view of FIG. 12A along the XIIB-XIIB line; and FIG. 12C is a sectional view of FIG. 12A along the XIIC-XIIC line.

In the state in which the female connector 2 and the male connector 13 are completely fitted into each other, as shown in FIG. 10, the second latch protrusion $P_2$ is latched onto the latch pawl L of the elastic latch arm 8. Simultaneously, the upward movement of the elastic latch arm 8 is restricted, because the first bent protrusion $D_1$ of the CPA 9 abuts the inner wall surface of the connecting part $\mathbf{5}_{A'}$ of the female housing 3. Thus, the fitting of the two connectors 2, 13 is locked.

In this state, when the two connectors are separated from each other, the curved part $\mathbf{9}_B$ of the CPA 9 is picked by the finger and is retreated backward to behind the female connector 2, i.e., in the direction shown by the arrow X in FIG. 10. By this retreating of the curved part $\mathbf{9}_B$, as shown in FIG. 11, the abutment of the first bent protrusion $D_1$ of the CPA 9 and the connecting part $\mathbf{5}_A$, is disengaged and the first bent protrusion $D_1$ is moved into the clearance groove $\mathbf{7}_B$. Simultaneously, the second bent protrusion $D_2$ of the CPA 9 mounts onto the beam part 8*a* and the connection of the first latch protrusion $P_1$ of the male connector 13 and the second bent protrusion $D_2$ of the CPA 9 is disengaged. In this state, when the male connector 13 is pulled up from the female connector 2, it is pulled up while the second latch protrusion $P_2$ lifts the elastic latch arm 8, so that the two connectors can be easily separated. In addition, when the curved part $\mathbf{9}_B$ is released from the picked state by the finger, the CPA 9 is returned to the original position thereof. Since the CPA 9 is fixed to the female housing 3, even by the above-noted operations, the CPA 9 is never removed from the female housing 13.

The invention claimed is:

1. An electrical connector comprising:

a first connector including a first connector housing with a first latch part provided on a peripheral wall surface of said first connector housing;

a second connector including a second connector housing with a portion defining an inserting hole into which said first connector housing is fitted provided inside said second connector housing; and a connector position assurance for detecting a fitted state of said first and second connectors;

said first latch part of said first connector including a pair of a first latch protrusion and a second latch protrusion arranged with a space therebetween in a direction in which said first connector housing is fitted, said second connector including an elastically deformable latch arm in said inserting hole of said second connector housing with a predetermined space from one inner wall surface of said second connector housing, said latch arm extending in a direction in which said second connector is fitted and having a latch pawl at an end of said latch arm, said connector position assurance including:

an elastically deformable first finger piece having a first bent protrusion at an end of said first finger piece;

a second finger piece having a second bent protrusion at a position adjacent to said first finger piece and behind said first bent protrusion;

a spring-force-accumulated part which is connected to said first and second finger pieces and is elastically deformed by push-in of said first and second finger pieces are fitted; and an attaching part extending from an end of said spring-force-accumulated part;

said attaching part of said connector position assurance being fixed to said second connector housing;

said first and second finger pieces of said connector position assurance being fitted slidably in a fitted direction into a space between said elastic latch arm and said one inner wall surface;

if said first and second connectors are fitted, said first latch protrusion of said first connector reaches said second bent protrusion of said connector position assurance to make said connector position assurance slide backward and to accumulate spring force in said spring-force-accumulated part;

if a regular fitted state is achieved, said second latch protrusion latches onto said latch pawl of said elastic latch arm by means of spring recoil strength of said spring-force-accumulated part, and said first bent protrusion of said connector position assurance abuts said one inner wall surface to lock movement of said elastic latch arm.

2. The electrical connector according to claim 1, wherein said first latch protrusion comprises a pair of latch protrusions each of which is provided at either end of said second latch protrusion, one wall of said second connector housing facing said space has a portion defining a clearance groove which accommodates said first bent protrusion when said connector position assurance is pushed into said second connector housing, said latch pawl is provided toward said inserting hole, a deep part of said elastic latch arm has a disengaging part onto which said second bent protrusion mounts to disengage latching with said first latch protrusion, said second finger piece of said connector position assurance comprises a pair of second finger pieces each of which is provided at either end of said first finger piece.

3. The electrical connector according to claim 1, wherein said spring-force-accumulated part of said connector position assurance has a curved part which is curved by push-in of said first and second finger pieces to accumulate spring force, and said curved part protrudes from a wall surface of said second connector housing if said connector position assurance is fixed to said second connector housing of said second connector to serve as an operating part for separating said first and second connectors.

4. The electrical connector according to claim 1, wherein said second bent protrusion of said connector position assurance comprises:

a shoulder part which collides against said first latch protrusion; and a slide inclined surface that is inclined from said shoulder part at a predetermined angle.

5. The electrical connector according to claim 1, wherein said connector position assurance is formed integrally with a metal plate spring.

6. The electrical connector according to claim 1, wherein said second connector housing of said second connector comprises:

an inner housing to which a contact terminal is attached; and an outer housing which covers an outer surrounding area of said inner housing except a front and rear part of said inner housing with a predetermined space between said inner and outer housings in which said elastic latch arm is provided.

7. The electrical connector according to claim 1, wherein said elastic latch arm being made of a U-shaped arm piece whose bottom part is provided with said latch pawl; and said elastic latch arm extends from a rear wall of said second connector housing.

8. The electrical connector according to claim 1, wherein said first latch protrusion of said first connector comprises:

a shoulder part which collides against said second bent protrusion; and a slide inclined surface that is inclined from said shoulder part at a predetermined angle, and said second latch protrusion includes an inclined surface that slidingly contacts said latch pawl, and a shoulder part to be latched onto said latch pawl.

* * * * *